United States Patent [19]

Von Kemenczky

[11] 3,938,315

[45] Feb. 17, 1976

[54] ADJUSTABLE INTERVAL TIMER

[75] Inventor: Miklos Von Kemenczky, Greenbrook, N.J.

[73] Assignee: Paul Guilden, New York, N.Y.

[22] Filed: June 20, 1974

[21] Appl. No.: 481,140

[52] U.S. Cl. ..... 58/1 R; 58/144

[51] Int. Cl.[2] ..... G04F 1/04; G04F 1/08

[58] Field of Search ..... 58/1, 144; 92/9; 188/299, 188/313, 316

[56] References Cited

UNITED STATES PATENTS

| | | | |
|---|---|---|---|
| 2,144,857 | 1/1939 | Schultz | 58/144 |
| 2,417,641 | 3/1947 | Fischer | 58/1 R |
| 2,838,140 | 6/1958 | Rasmusson et al. | 92/9 |
| 3,822,544 | 7/1974 | Groves | 58/144 |

*Primary Examiner*—Edith Simmons Jackmon
*Attorney, Agent, or Firm*—Watson Leavenworth Kelton & Taggart

[57] ABSTRACT

Timing apparatus comprising a housing having a fluid-containing conduit and a body movable in the conduit under the influence of gravity includes a valve for controlling circulation of fluid in the conduit and thereby controlling the time elapsed during movement of the body between preselected locations. The housing supports a magnet for sliding movement when the body descends to its lowermost location and a member responsive to such magnet movement initiates audible output indication.

16 Claims, 5 Drawing Figures

ADJUSTABLE INTERVAL TIMER

FIELD OF THE INVENTION

This invention relates generally to timing apparatus and more particularly to devices in which the passage of a specified time interval is determined by gravity-induced movement of a body through a fluid medium.

BACKGROUND OF THE INVENTION

In various time-based games and the like, inexpensive clock mechanisms are unsatisfactory for a number of reasons, not the least of which is the continuous distraction they present due to ticking and like audible effects of jointly moving parts. Thus, in games involving the completion of mental activity within a prescribed time period, the provision of a distracting indication, i.e., a sound, is evidently desirable only at the expiration of the involved time period. In addition to their continuous distraction, inexpensive clock mechanisms have generally inadequate durability and are often the one element of a game determining the period of usefulness thereof.

Timing apparatus of the type in which a body is movable through a viscous fluid to measure preselected time intervals is well known in the art, as evidenced typically in U.S. Pat. Nos. 2,714,927, 3,025,665, 3,111,004, 3,166,839, 3,240,007 and 3,533,229. These devices, simple in structure, durable and relatively inexpensive, are completely noiseless in operation, to the extent of providing no output indication of the expiration of the measured time period. Thus, it is incumbent upon the user to observe the movement of the body at the end of its travel to determine the ending of the time period. A further shortcoming of such known noiseless devices, insofar as they are adapted to measure different time intervals, is their requirement for structure parent to the fluid-containing housing thereof for tilting the same to define an off-vertical descent path for the movable body.

SUMMARY OF THE INVENTION

It is an object of the present invention to provide durable and inexpensive timing apparatus which is noiseless in the course of its measurement of the passage of a time interval and provides terminal output indication.

It is a further object of the invention to provide durable and inexpensive timing apparatus which is readily adjustable to provide for the measurement of the passage of different time intervals.

In the attainment of the foregoing and other objects the invention provides timing apparatus comprising a housing having a fluid-containing conduit, a body movable in the conduit from a first to a second location and means for controlling circulation of fluid in the conduit to thereby control the time elapsed in gravity-induced movement of the body between the first and second locations. The fluid circulation control is preferably effected by a valve adjustably restricting fluid flow in one direction, i.e., during time interval measurement, and providing substantially unrestricted fluid flow in reverse direction upon inverting the housing to ready the timing apparatus for further use. Timing apparatus according with the invention preferably incorporates a magnet movable in the housing upon passage of the measured time interval and means responsive to such magnet movement to provide audible output indicative thereof.

The foregoing and other objects and features of the invention will be evident from the following detailed description of preferred embodiments thereof and from the drawings wherein like reference numerals identify like parts throughout.

DETAILED DESCRIPTION OF PREFERRED EMBODIMENTS

Figure 1:
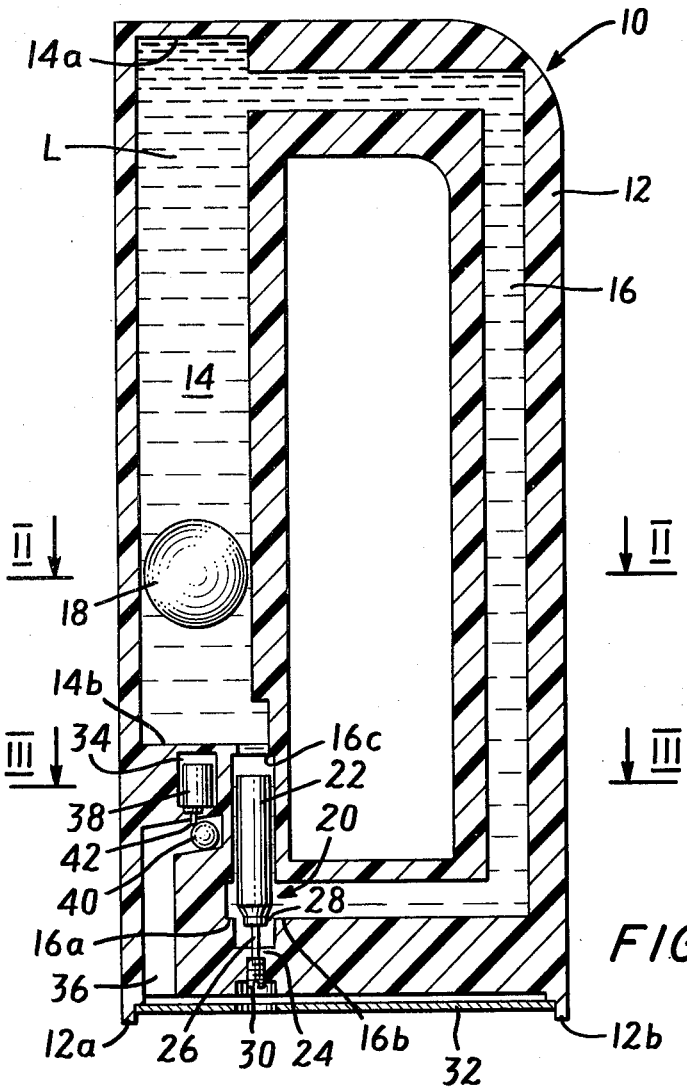
FIG. 1 is a front elevational view of timing apparatus in accordance with the invention with housing 12 vertically sectioned to show parts therein unsectioned.
Figure 2:
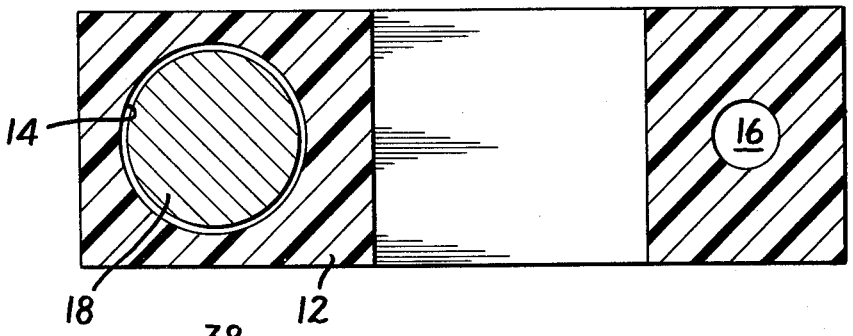
FIG. 2 is a sectional plan view as seen from the plane II—II of FIG. 1.
Figure 3:
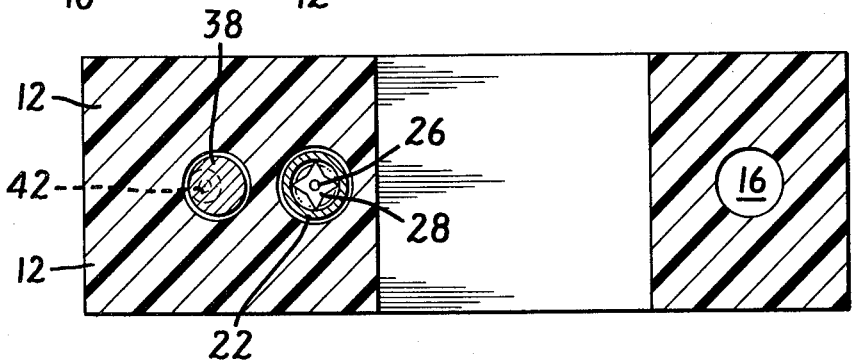
FIG. 3 is a sectional plan view from the plane III—III of FIG. 1.

Referring to FIGS. 1 through 3, timing apparatus 10 is comprised of a plastic translucent housing 12 upstanding from base legs 12*a* and 12*b* and defining endless conduit means comprising a first conduit or passage 14, generally vertically extending and a second conduit 16 connected endwise across conduit 14 in the vicinity of end walls 14*a* and 14*b* thereof. Conduit 14 is preferably of circular cross section and a body 18, desirably a solid spherical body, e.g., a steel ball, is disposed in conduit 14 for gravity-induced movement between end walls 14*a* and 14*b*, which respectively define first and second locations in the housing between which body 18 is movable. Conduits 14 and 16 contain a viscous liquid L which may circulate therebetween during operation of the timing apparatus as discussed below.

In accordance with the invention, means are included in the FIG. 1 apparatus for controlling circulation of fluid through conduits 14 and 16, thereby controlling the time which may elapse in gravity-induced movement of body 18 between end walls 14*a* and 14*b*. Such fluid circulation control means in the FIG. 1 apparatus are situated in conduit 16 and take the form of a valve 20 disposed in conduit 16 adjacent and vertically below end wall 14*b*. Valve 20 includes a fluid conducting element 22 slidably movable in conduit 16 and comprising a hollow sleeve having an outer diameter slightly less than the diameter of the encircling portion of conduit 16. Valve 20 further includes a valve seat defined by walls 16*a* and 16*b* of conduit 16 and a valve controller 24 adapted to variably position element 22 in relation to the valve seat when housing 12 is in its illustrated upstanding disposition. Controller 24 includes a stem 26, a star-shaped support 28 (FIG. 2) engageable with element 22 and a screw 30 integral with stem 26, having threads engageable with counterpart threads in the housing and adjustable exteriorly of the housing through a suitable opening in base plate 32. In the illustrated setting of screw 30, stem 26 and support 28 position element 22 in a manner partially closing valve 20 and restricting the flow of fluid from conduit 14 through element 22 and into conduit 16. If screw 30 is adjusted such that element 22 is positioned in its lowermost position, element 22 and the valve seat are in valve closing engagement and define a condition of minimum circulation of fluid between conduits 14 and 16, i.e., as permitted by the amount of clearance between element 22 and the encircling portion of conduit 16. As such, controller 24 and conduit walls 16*a* and 16*b* comprise a virtual closure means for element 22.

The rate of gravity-induced movement of body 18 in conduit 14 is least under the last-described circumstance. Thus, where minimum fluid circulation occurs between conduits 14 and 16, the rate of descent of body 18 is a function of the viscosity of the contained fluid, the density of the body, the amount of clearance between body 18 and the encircling wall of conduit 14, and the amount of clearance between element 22 and the encircling portion of conduit 16. Conversely, when screw 30 is adjusted to position the element 22 in its uppermost position, i.e., wherein support 28 is upward of conduit walls 16*a* and 16*b*, fluid circulation between conduits 14 and 16 is relatively unrestricted and the rate of descent of body 18 is dependent on fluid viscosity, body 18 density, the clearance between body 18 and the encircling wall of conduit 14 and the respective diameters of conduits 14 and 16.

In use of the timing apparatus of the invention, screw 30 is initially set and gravity-induced movement of body 18 from its first location to its second location is timed by an independent calibrating time piece. Screw 30 is then adjusted repeatedly until gravity-induced movement of body 18 between such locations occurs coincidently with expiration of the time period desired. Graduation marks may be inscribed on the face of the housing overlying conduit 14 to aid in rapid adjustment of screw 30.

In order to dispose body 18 in its first location, i.e., at end wall 14*a* of conduit 14, and thus set the timing apparatus for use, the timing apparatus is inverted from its illustrated upstanding disposition. As this occurs, element 22 is slidably displaced by gravity, assisted by fluid flow in the same direction, and abuts against end wall 16*c* of conduit 16. Since element 22 is now remotely positioned both from the valve seat and support 28, support 28 being fixedly secured to stem 26, there is substantially unrestricted fluid flow between conduits 14 and 16. Under this condition, as contrasted with the adjustable restricted fluid flow when the housing is upstanding, body 18 experiences a rate of gravity-induced movement toward end wall 14*a* greater than its above-considered adjustable rate of gravity-induced movement toward end wall 14*b*, thus facilitating rapid setting (or resetting) of the apparatus.

In a further aspect of the invention, the timing apparatus of FIG. 1 includes an arrangement conveniently dispensing with the customary need to observe the movement of a body in a viscous fluid timing device. Thus, in the illustrated apparatus output indication is provided upon the passage of the time interval of concern. For this purpose, housing 12 defines, in addition to conduit or passage 14, additional generally vertically extending passages 34 and 36. Passage 36 is shaped in inverted L-form with the upper portion thereof inclining downwardly from the horizontal. A magnet 38 is disposed in passage 34 for movement between the end walls thereof and a spherical body 40 is situated in passage 36 for movement therein. The exit or lower end of passage 34 is arranged adjacent base plate 32. Body 18 has greater mass than does body 40 and both body 18 and body 14 are comprised of magnetically-attractable material, i.e., a material that is attracted to magnets, such as a ferromagnetic material.

Figure 4A:
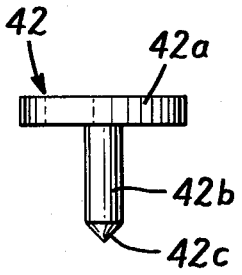
FIGS. 4(a) and 4(b) are front elevational enlarged views of embodiments of stop members for use in the FIG. 1 apparatus.
Figure 4B:
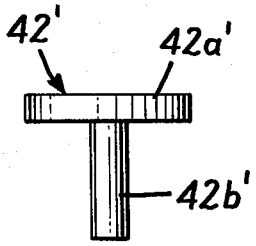

With the parts arranged as in FIG. 1 and body 18 in the midst of gravity-induced movement toward end wall 14b, magnet 38 is situated at the lower end wall of passage 34 by gravity influence on the magnet and by magnetic attraction of body 40. Body 40 ia impeded from moving outwardly of the upper portion of passage 36 by magnetic force of attraction between magnet 38 and body 40. As body 18 moves further downwardly into its second location, at end wall 14*b*, the magnetic force of attraction between body 18 and magnet 38 exceeds the magnetic force of attraction then existing between body 40 and magnet 38, with resulting movement of magnet 38 to the upper end wall of passage 34. On this occurrence, magnetic attraction between bodies 38 and 40 is insufficient to hold body 40 in place against the force of gravity and body 40 moves out of the upper portion of and throughout passage 36 and strikes base plate 32 providing audible output indication. Upon inversion of the timing apparatus, body 18 moves toward and is eventually repositioned in its first location and body 40 is repositioned in the upper portion of passage 36. With body 18 outside of the sphere of magnetic influence thereof, magnet 38 moves toward and reassumes its motion-impeding magnetic influence upon body 40.

Where the timing apparatus thus described is subject to environmental vibrations and the like, occasions can arise where body 40 may be jarred free of the retaining magnetic influence of magnet 38. The upper portion of passage 36 is downwardly inclined and on such occasions body 40 thus experiences a sideward force component when it engages the floor of such upper passage portion and tends to move outwardly thereof. To impede movement of body 40 under these circumstances, a mechanical motion impeding or stop means in the form of stop member 42 is preferably employed. The lower end wall of passage 34 defines an opening extending into passage 36. In a first embodiment, stop member 42 is desirably in the form of a pin [FIG. 4(a)] movable in such opening and positionable so as to extend into passage 36 to provide selective physical impediment to sideward motion of body 40, i.e., is fixedly positioned in the passage only when magnet 38 is supported on the lower end wall of passage 34 and exerts downward force on the pin, such force being the combined weight of magnet 38 and its force of attraction to body 40. Stop member 42 is thus of such weight that it alone exerts no lasting physical restraint on sideward movement of body 40. Accordingly, when magnet 38 moves to the upper end wall of passage 34, the stop member is readily displaced upwardly and out of the path of gravity-induced movement thereof by body 40 impinging against inclined plane 42*c*. Member 42 is comprised throughout of non-magnetically permeable material in this first embodiment. As shown in FIG. 4(b), in a second embodiment, stop member 42' includes a head portion 42*a'* comprised of magnetically-attractable material and a non-magnetic shaft 42*b'* extending from the head portion and movable into passage 36. In this arrangement, magnet 38 engages portion 42*a'* and the stop member is withdrawn from passage 36 by magnetic force of attraction to the magnet upon movement of magnet 38 upwardly in passage 34. Shaft 42*b* is comprised of non-magnetically permeable material such that no magnetically permeable material is in engagement with body 40 which would interfere with its above-discussed movements.

Various changes and modifications evident to those skilled in the art may be introduced in the foregoing particularly described embodiments without departing from the spirit of the invention. Thus, while bodies 18 and 40 are particularly disclosed as steel balls, these bodies may take on any suitable configuration. Magnet 38 is preferably a molded ceramic magnet but may be of other suitable character. Accordingly, the foregoing particularly described embodiments are intended in an illustrative and not in a limiting sense. The true spirit and scope of the invention is defined in the following claims.

What is claimed is:

1. Timing apparatus comprising a housing containing a fluid, conduit means in said housing for circulating said fluid, body means in said conduit means for gravity-induced movement between first and second preselected locations in said housing and means for controlling circulation of fluid in said conduit means, thereby controlling the time elapsed in said gravity-induced movement of said body between said first and second locations, said fluid circulation control means comprising a valve having a fluid conducting element slidably supported in said conduit means, closure means for closing said fluid conducting element, and adjustable means for supporting said fluid conducting element in engaging relation with said closure means when said housing is in upstanding disposition whereby fluid flow in said conduit means is adjustably restricted in a first circulating direction, said fluid conducting element sliding from said engaging relation with said closure means when said housing is inverted from said upstanding disposition thereof whereby fluid flow in said conduit means is substantially unrestricted in a second circulating direction opposite to said first circulating direction.

2. The timing apparatus claimed in claim 1 wherein said conduit means comprises a first conduit in which said body means is movable and a second conduit connected endwise across said first conduit, said valve being disposed in said second conduit.

3. The timing apparatus claimed in claim 1 further including means for providing output indication upon movement of said body means from said first location to said second location.

4. The timing apparatus claimed in claim 3 wherein said conduit means comprises a first conduit in which said body means is movable and a second conduit connected endwise across said first conduit, opposed ends of said first conduit respectively constituting said first and second locations.

5. The timing apparatus claimed in claim 4 wherein said body means is a solid body and wherein said first and second conduits are of circular cross-section.

6. The timing apparatus claimed in claim 3 wherein said body means is comprised of magnetically-attractable material, said means providing output indication comprising a magnet translatable in said housing by magnetic attraction to said body means upon said movement thereof from said first location to said second location and means operatively responsive to such magnet translation for providing sensible output indication.

7. The timing apparatus claimed in claim 6 wherein said sensible output indication providing means comprises a further body means comprised of magnetically-attractable material and maintainable in a first position in said housing by magnetic attraction to said magnet and releasable for predetermined movement in said housing upon said magnet translation and means providing audible output upon said predetermined movement of said further body means.

8. The timing apparatus claimed in claim 1 wherein said body means is a solid body and wherein said conduit means is of circular cross-section.

9. The timing apparatus claimed in claim 2 wherein said body means is a solid body and wherein said first and second conduits are of circular cross-section.

10. Timing apparatus comprising a housing having a fluid-containing conduit, body means comprised of magnetically-attractable material for gravity-induced movement in said conduit from a first location to a second location, a magnet translatable in said housing by magnetic force of attraction between said magnet and said body means upon movement thereof into said second location and means operative upon such magnet translation for providing output indication of said movement of said body means into said second location.

11. The timing apparatus claimed in claim 10 wherein said output indication providing means comprises further body means comprised of magnetically-attractable material for gravity-induced movement in said housing and having less mass than said first-mentioned body means, said magnet retaining said further body means in fixed position in said housing by magnetic force of attraction between said magnet and said further body means when said first-mentioned body means is in locations other than said second location, said further body means being otherwise gravity movable, and means responsive to such gravity-induced movement of said further body means for providing output indication of said gravity-induced movement thereof.

12. Apparatus for indicating the passage of a predetermined time period comprising an upstanding housing having a first fluid-containing passage, first body means comprised of magnetically-attractable material for movement throughout said first passage for defining said time period, a second passage vertically below said first passage and having upper and lower end walls, a magnet movable in said second passage, a third passage vertically below said second passage and second body means comprised of magnetically-attractable material for movement in said third passage, said first body means having mass greater than said second body means whereby said magnet impedes movement of said second body means by magnetic force of attraction therebetween when said magnet is disposed at said second passage lower end wall and whereby said magnet is moved to said second passage upper end wall by magnetic force of attraction to said first body means when said first body means is moved by gravity throughout said first passage, said second body thereupon being moved by gravity throughout said third passage and providing indication of said passage of said time period.

13. The apparatus claimed in claim 12 further including stop means positioned in said third passage upon disposition of said magnet at said second passage lower end wall for engaging said second body means to impede movement thereof.

14. The apparatus claimed in claim 13 wherein said second passage lower end wall defines an opening extending into said third passage, and wherein said stop means comprises a pin member movable in said opening into said third passage, said magnet engaging said pin member upon said disposition of said magnet at said second passage lower end wall and thereby fixedly positioning said pin member in said third passage.

15. The apparatus claimed in claim 14 wherein said pin member includes a portion comprised of magnetically-attractable material with which said magnet is engageable, said pin member being withdrawn from said third passage by magnetic force of attraction to said magnet upon movement of said magnet to said second passage upper end wall.

16. The apparatus claimed in claim 14 wherein said pin member is comprised of non-magnetically permeable material.

* * * * *